US011771960B2

(12) United States Patent
Cardon et al.

(10) Patent No.: US 11,771,960 B2
(45) Date of Patent: Oct. 3, 2023

(54) WETTING BALL

(71) Applicant: Universiteit Gent, Ghent (BE)

(72) Inventors: Ludwig Cardon, Ninove (BE); Mustafa Erkoc, Temse (BE); Dagmar D'Hooge, De Pinte (BE); Stijn Rambour, Zonnnebeke (BE)

(73) Assignee: Universiteit Gent, Ghent (BE)

( * ) Notice: Subject to any disclaimer, the term of this patent is extended or adjusted under 35 U.S.C. 154(b) by 0 days.

(21) Appl. No.: 17/772,707

(22) PCT Filed: Dec. 1, 2020

(86) PCT No.: PCT/EP2020/084075
§ 371 (c)(1),
(2) Date: Apr. 28, 2022

(87) PCT Pub. No.: WO2021/110658
PCT Pub. Date: Jun. 10, 2021

(65) Prior Publication Data

US 2022/0387858 A1 Dec. 8, 2022

(30) Foreign Application Priority Data

Dec. 3, 2019 (EP) ..... 19213192

(51) Int. Cl.

| | |
|---|---|
| ***A63B 43/00*** | (2006.01) |
| ***A63B 37/02*** | (2006.01) |
| ***A63B 37/12*** | (2006.01) |
| ***A63B 37/14*** | (2006.01) |
| *A63B 102/22* | (2015.01) |

(52) U.S. Cl.
CPC ..... *A63B 43/002* (2013.01); *A63B 37/02* (2013.01); *A63B 37/12* (2013.01); *A63B 37/14* (2013.01); *A63B 2102/22* (2015.10)

(58) Field of Classification Search
CPC ..... A63B 43/002; A63B 37/02; A63B 37/12; A63B 37/14; A63B 2102/22
See application file for complete search history.

(56) References Cited

U.S. PATENT DOCUMENTS

| | | | | |
|---|---|---|---|---|
| 4,991,847 A * | 2/1991 | Rudell | A63F 9/0278 | 473/594 |
| 5,280,906 A * | 1/1994 | Vitale | A63B 43/00 | 273/DIG. 20 |
| 5,335,907 A * | 8/1994 | Spector | A63B 41/02 | 273/DIG. 8 |

(Continued)

OTHER PUBLICATIONS

International Search Report for International Application No. PCT/EP2020/084075, dated Feb. 26, 2021, 3 pages.

(Continued)

*Primary Examiner* — Steven B Wong
(74) *Attorney, Agent, or Firm* — TraskBritt

(57) ABSTRACT

This disclosure relates to a ball comprising a core and a porous structure encompassing the core. The porous structure comprises a plurality of perforations in its outer surface, which are connected with a plurality of hollow confined spaces within the porous structure allowing a liquid to be at least partly absorbed by the hollow confined spaces upon contact of the ball with the liquid. A shell with shell perforations encompasses the porous structure. The ball comprises control means for controlling the absorption of liquid by the ball and the release of absorbed liquid from the ball.

18 Claims, 7 Drawing Sheets

(56) References Cited

U.S. PATENT DOCUMENTS 5,462,273 A * 10/1995 Spector ..... A63B 41/02 273/DIG. 8
6,012,997 A 1/2000 Mason
6,908,662 B2 * 6/2005 Pearce ..... A63H 33/18 428/188
6,939,193 B1 * 9/2005 McDowell ..... A63B 67/10 482/110
8,029,393 B2 * 10/2011 Frazier ..... A63B 43/002 473/577
D648,406 S * 11/2011 Hochberg ..... D21/713
2003/0176246 A1 * 9/2003 Gaff ..... A63B 41/08 473/605
2006/0251830 A1 11/2006 Brandon
2008/0099994 A1 * 5/2008 Tuttle ..... A63F 7/00 273/280
2008/0242457 A1 * 10/2008 Chia ..... A63B 43/00 473/594
2008/0287218 A1 11/2008 Freund
2011/0111896 A1 * 5/2011 Frazier ..... A63B 43/002 473/611
2012/0021857 A1 * 1/2012 Raymond ..... A63B 41/08 473/603
2014/0274504 A1 * 9/2014 Hu ..... A63B 37/06 473/604
2016/0375316 A1 * 12/2016 Bailey ..... A63B 69/0026 473/607

OTHER PUBLICATIONS

International Written Opinion for International Application No. PCT/EP2020/084075, dated Feb. 26, 2021, 6 pages.

* cited by examiner

WETTING BALL

CROSS-REFERENCE TO RELATED APPLICATIONS

This application is a national phase entry under 35 U.S.C. § 371 of International Patent Application PCT/EP2020/084075, filed Dec. 1, 2020, designating the United States of America and published as International Patent Publication WO 2021/110658 A1 on Jun. 10, 2021, which claims the benefit under Article 8 of the Patent Cooperation Treaty to European Patent Application Serial No. 19213192.8, filed Dec. 3, 2019.

TECHNICAL FIELD

The disclosure relates to the field of balls suitable of wetting a surface. More specifically, the disclosure relates to sport balls suitable of wetting a surface during play, such as, for instance, hockey balls.

BACKGROUND

In ball sports like hockey intensive wetting of the artificial turf field is done to ensure the desired interaction between the ball and the artificial turf field. However, intensive wetting of the field is expensive since installation costs of pumping systems for water are high and water often needs to be at least partially supplied. Moreover, recycling of water can be non-trivial due to the presence of algae. In view of the limited water resources and the challenge of the society to strive for sustainability it is recommended to minimize water consumption for the field preparation without drastically hindering the play comfort.

U.S. patent application 2006/0251830 describes an artificial grass system comprising an additional liquid release layer underneath the artificial blades of grass and a capillary channel extending from within the liquid release layer to the main surface. By the capillary effect, the capillary channels, upon losing liquid, will fill themselves again with liquid from the release layer and carry this to the main surface, allowing the liquid to be continuously fed from underneath the main surface. A disadvantage of this artificial grass system is that it requires at least a part of the existing grass systems to be replaced. Moreover, such system is still using large water amounts and is prone to substantial installation costs.

BRIEF SUMMARY

Provided is an alternative wetting strategy, in particular, a wetting strategy using a ball.

This disclosure relates to a ball comprising a core and a porous structure encompassing the core. The core comprises a substantially impermeable outer surface. The porous structure is delimited by an outer surface and an inner surface. In preferred embodiments of this disclosure, the inner surface of the porous structure coincides with the outer surface of the core. The outer surface of the porous structure comprises a plurality of perforations. The porous structure further comprises a plurality of hollow confined spaces. At least a part of the plurality of the porous structure perforations and at least a part of the plurality of hollow confined spaces are interconnected thereby defining a plurality of first liquid passages. The ball further comprises a shell encompassing the porous structure. The shell is delimited by a shell outer surface and a shell inner surface. In embodiments of this disclosure, the shell inner surface is the same as or coincides with the outer surface of the porous structure. In embodiments of this disclosure, a perforated foil is provided between the shell inner surface and the outer surface of the porous structure. The shell comprises a plurality of shell perforations. At least a part of the plurality of shell perforations extend between a shell outer opening in the shell outer surface and a shell inner opening in the shell inner surface. The at least part of the plurality of shell perforations are interconnected with the perforations of the porous structure thereby defining a plurality of second liquid passages. The first and second liquid passages thereby define liquid passages between the shell perforations and the hollow confined spaces and allow a liquid to be absorbed by the hollow confined spaces upon contact of the ball with the liquid. As an example, without being limited thereto, contact of the ball with the liquid may be performed by immersing the ball in a liquid or by sprinkling the ball with the liquid or in any other way considered suitable by the person skilled in the art. The ball further comprises control means for controlling absorption of liquid by the ball, for instance, upon immersion of the ball in the liquid during a predetermined time period, e.g., to control the absorption rate of liquid by the ball and/or the amount of absorbed liquid by the ball upon contact, e.g., upon immersion, of the ball with the liquid during a predetermined time period and/or for controlling release of the absorbed liquid by the ball, e.g., to control the desorption rate and/or the amount of release of the absorbed liquid from the porous structure after implying a predetermined force to the ball, for instance, after a ball rebound test or after hitting the ball with a predetermined force or any other way considered suitable by the person skilled in the art.

In embodiments of this disclosure, the control means are structural control means, i.e., adaptations of structural features of the ball within certain ranges or additions of structural features as will be explained further in specific examples of embodiments of this disclosure.

In embodiments of this disclosure, the interconnections between the shell perforations and the hollow confined spaces can be regulated by structural variations of the ball, i.e., for instance, the size, number, geometry of the shell perforations and/or shell channels, the size, number and geometry of the porous structure perforations and/or porous structure channels and/or the connection between shell perforations and porous structure perforations, the ball as such being adapted in such a way that the absorption and release of liquid by the ball is controlled and/or that the absorbed liquid is temporally stored in the hollow confined spaces in the absence of forces exerted on the ball (e.g., when the ball is at rest). In embodiments of this disclosure, the ball is adapted in such a way that at least a part of the absorbed liquid is released from the ball upon exertion of minimum external forces on the ball (the minimum external forces to be exerted on the ball may be chosen depending on the application the ball is used for), e.g., upon dropping the ball from a predetermined height and/or upon hitting the ball during playing with the ball, e.g., upon hitting the ball with a hockey stick during hockey play with a predetermined force.

In embodiments of this disclosure, the porous structure comprises a foam structure. In embodiments of this disclosure, the porosity of the foam structure may be adapted to control the absorption of liquid by the ball, for instance, upon immersion of the ball in the liquid during a predetermined time period, e.g., to control the absorption rate of liquid by the ball and/or the amount of absorbed liquid by the ball upon contact, e.g., upon immersion, of the ball with the liquid during a predetermined time period. In embodiments of this disclosure, the porosity of the foam structure may be adapted to control the desorption of absorbed liquid by the ball, i.e., to control the conditions upon which absorbed liquid may be released again, e.g., to control the desorption rate and/or the forces to be exerted on the ball to allow desorption and/or the control the amount of released liquid when implying a predetermined force on the ball. The porosity of the foam structure may be adapted in any way considered suitable by the person skilled in the art, for instance, by adapting the porosity of the foam structure, by varying the porosity with varying distance to the core, e.g., by decreasing or increasing the porosity with increasing distance from the core.

For sport balls, e.g., hockey balls, the foam structure may comprise pores with a size between 1 μm and 2 mm, preferably between 1 μm and 1 mm.

In embodiments of this disclosure, the plurality of perforations at the outer surface of the porous structure extend in a plurality of channels extending at least partly through the porous structure. In embodiments of this disclosure, the plurality of channels extend from the outer surface of the porous structure to the outer surface of the core. In embodiments of this disclosure, the plurality of channels interconnect the plurality of perforations in the porous structure with the plurality of hollow confined spaces in the porous structure. In embodiments of this disclosure, the plurality of channels comprise an inlet opening interconnected to the porous structure perforations and one or more outlet openings interconnected to the hollow confined spaces, as such creating a liquid flow path between the perforations of the porous structure and the hollow confined spaces of the porous structure, e.g., the pores of the foam structure. In embodiments of this disclosure, the one or more outlet openings may be provided in the side surface of the channel and the inlet opening may be provided in the base surface of the channel. In embodiments of this disclosure, the channels are tubular structures comprising two base surfaces and a tubular side surface. In this case the inlet opening will typically be provided in the top base surface and the one or more outlet openings will typically be provided in the side surface and/or bottom surface of the tubular structure.

The channels may be adapted to control the absorption of liquid by the ball and desorption of absorbed liquid by the ball, as such forming at least part of the structural control means. The channels may be adapted in any way considered suitable by the person skilled in the art, for instance, without being limited thereto, by adapting the size, e.g., the diameter and/or length, of the channels, by varying the size of the channel with varying distance to the core, e.g., by decreasing or increasing the size, e.g., the diameter, of the channel with increasing distance from the core, by varying the number and/or size of the outlet openings/holes (if any) in the channels, the holes providing an interconnection toward the confined hollow spaces.

The perforations of the porous structure and/or the channels extending from the porous structure may have a maximal size/diameter between 0.3 mm and 1 mm. This size is defined perpendicular to the direction in which liquid enters the channel from outside the ball. The length of the channels, i.e., the distance between the channel inlet opening and the channel outlet opening is preferably between 4 and 10 mm. The holes in the circumferential surface of the channels (if any) may have a size, e.g., a diameter, between 0.1 mm and 1 mm. Such ranges are suitable, in particular, for sport balls, e.g., hockey balls.

In embodiments of this disclosure, the shell inner openings of the plurality of shell perforations are positioned in a specific pattern with respect to the perforations of the porous structure. In embodiments of this disclosure, the shell inner openings of the shell perforations and the perforations of the porous structure partially or completely align or overlap, as such providing an interconnection between both and providing a liquid passage from the shell perforations toward the hollow confined spaces.

In embodiments of this disclosure, the shell perforations comprise shell channels extending between the shell outer opening and the shell inner opening. In embodiments of this disclosure, the shell outer opening comprises a dimple, which may extend further in a shell channel toward the shell inner opening. For hockey ball applications, the dimple typically has a conical shape, narrowing from the outside toward the inside of the shell.

In embodiments of this disclosure, the shell perforations and perforations of the porous structure form a liquid channel connecting the outside to the hollow confined spaces and allowing a liquid to be absorbed by the ball and stored at least temporarily in the hollow confined spaces.

In embodiments of this disclosure, the plurality of shell perforations have a maximal size/diameter between 0.3 mm and 1 mm. Such range is suitable, in particular, for sport balls, e.g., hockey balls.

In embodiments of this disclosure, at least part of the shell perforations comprise a channel, extending between the shell outer opening and shell inner opening, the channel having a diameter between 0.3 mm and 1 mm. Such channels may form part of the control means, controlling the absorption and release of water by the ball. This size of a channel or perforations may be defined in the direction perpendicular with respect to the entry of liquid from outside the ball.

In embodiments of this disclosure, the plurality of shell perforations have a size varying with the distance to the core of the ball. As an example, the diameter of the shell perforations, e.g., the diameter of the channels between the shell inner and outer opening, may increase from the outer surface of the porous structure toward the outer surface of the shell, allowing a better control of liquid uptake and release by the ball.

In embodiments of this disclosure, the ball comprises a perforated foil between the shell and the porous structure. The perforated foil may create a perturbated liquid flow path between the shell perforations and the hollow confined spaces of the porous structure, and may as such form at least a part of the control means of the ball for controlling the absorption and release of the liquid by the ball. Thereto, according to embodiments of this disclosure, the perforated foil is loosely provided in a limited space between the shell and porous structure. Loosely providing a perforated foil means that the foil is not fixated but that the foil can be pushed back and forward when fluid is being absorbed or released thereby creating perturbations in the fluid flow path. In addition thereto or optionally, in embodiments of this disclosure, the foil perforations do not (completely) align or overlap with the shell perforations so that the fluid passage from shell to the porous structure is delayed and/or controlled. The thickness of the perforated foil is preferably between 50 and 200 μm. In embodiments of this disclosure where the ball comprises a perforated foil between the shell and the porous structure, the porous structure preferably comprises a foam structure.

In embodiments of this disclosure, the ball, according to this disclosure, is a sports ball, preferably a hockey ball. The hockey ball may be adapted for playing hockey on a surface whereby the control means of the ball are adapted for releasing at least a part of the absorbed liquid when hitting the ball with a predetermined force during play. As such, the hockey ball can be used to wet a surface during play, avoiding or reducing the need to wet the surface in advance.

In embodiments of this disclosure, the ball, according to the disclosure, is used to wet a surface; for instance, to wet a surface during playing with the ball; for instance, while playing hockey; for instance, while hitting the ball with a hockey stick during play. Such use may comprise as a first step immersion of the ball in a liquid reservoir during a predetermined time period. The predetermined time period may be chosen such that a sufficient amount of liquid can be absorbed by the ball and stored in the hollow confined spaces of the ball. In a second step at least a part of the absorbed liquid will be released again by hitting the ball during play with a predetermined force, for instance, when hitting the ball with a hockey stick. Upon re-immersing the ball in a liquid reservoir liquid absorption can again be realized and the balls can be re-used again to wet a surface. The following parameters, without being limited thereto, may determine the amount of liquid that can be absorbed by the ball and/or the time period within which the liquid can be absorbed by the ball and/or the predetermined force that is needed to release a part of the liquid again, and as such form part of the control means of the ball: the diameter of the core, the core filling degree, the number of perforations in the outer surface of the porous structure, the porosity of the porous structure and the distribution of porosities, the size and geometry of the channels in the porous structure, the number of holes in the circumferential surface of the channels of the porous structure, the size of the hollow confined spaces, the number of shell perforations, the size and geometry of the shell perforations, the shell thickness, flow perturbation by the presence of a perforated foil between the shell and the porous structure, the number of perforations in the perforated foil, the positioning of the latter perforations with respect to the shell perforations, and the material types used to make the layers in the balls. In embodiments of this disclosure, the control means at least comprise shell channels provided between the shell outer and shell inner opening interconnecting the shell perforations and the porous structure perforations. In embodiments of this disclosure, the control means at least comprise channels in the porous structure interconnecting the porous structure perforations and the hollow confined spaces.

The ball, according to this disclosure, and its use may reduce the need to wet the surface in advance. Instead the ball itself wets the surface during play by releasing a part of the absorbed liquid when hitting the ball.

It is an advantage of embodiments of this disclosure that a ball is provided that is suitable for wetting a surface based on the temporally storage of a liquid in the ball after immersion of the ball in that liquid.

It is an advantage of embodiments of this disclosure that a ball is provided that is able to wet an artificial grass field during play.

It is an advantage of embodiments of this disclosure that a ball is provided that is able to wet a surface when minimum predetermined forces are exerted on the ball, e.g., upon hitting the ball during play.

It is an advantage of embodiments of this disclosure that a ball is provided that is able to absorb a liquid, temporarily store the liquid in the ball, and desorb the liquid.

It is an advantage of embodiments of this disclosure that a ball is provided for which the absorption rate and desorption rate can be controlled.

It is an advantage of embodiments of this disclosure that a ball is provided that allows to control the bouncing of the ball due to damping by liquid take-up.

Particular and preferred aspects of the disclosure are set out in the accompanying independent and dependent claims. Features from the dependent claims may be combined with features of the independent claims and with features of other dependent claims as appropriate and not merely as explicitly set out in the claims.

These and other aspects of the disclosure will be apparent from and elucidated with reference to the embodiment(s) described hereinafter.

Figure 1:
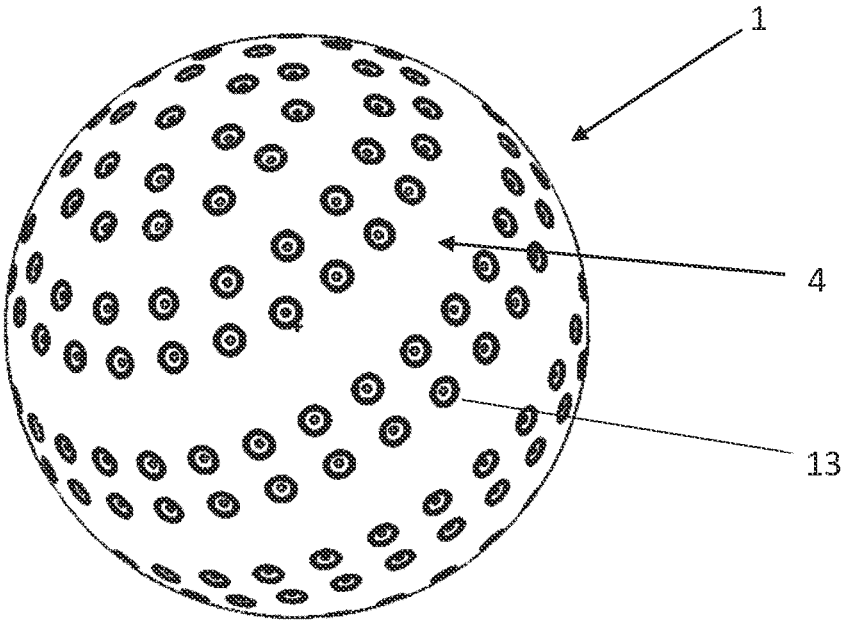
FIG. 1 is a perspective view of a ball according to an embodiment of this disclosure, including a shell with shell perforations.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION

This disclosure will be described with respect to particular embodiments and with reference to certain drawings but the disclosure is not limited thereto but only by the claims. The dimensions and the relative dimensions do not correspond to actual reductions to practice of the disclosure.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the disclosure described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the disclosure described herein are capable of operation in other orientations than described or illustrated herein.

It is to be noticed that the term "comprising," used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to this disclosure, the only relevant components of the device are A and B.

Reference throughout this specification to "one embodiment" or "an embodiment" means that a particular feature, structure or characteristic described in connection with the embodiment is included in at least one embodiment of this disclosure. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly, it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed disclosure requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Where in embodiments of this disclosure reference is made to a liquid, reference is preferably made to a non-gaseous liquid under normal conditions.

Core

The core (2) of the ball (1), according to this disclosure, may have any shape considered suitable by the person skilled in the art. Preferably, the core (2) has a similar shape as the shape of the overall ball (1). Preferably, the overall ball (1) has a spherical shape and the core (2) has therefore preferably a spherical shape, as shown in FIGS. 2-9. A spherical shape of the core (2) provides a better control over the rolling of the ball (1) on a surface. A spherical core (2) allows a better control over the center of gravity of the overall ball (1) provided that sufficient mass is present in this core (2). In particular, a spherical core (2) allows the center of gravity to coincide with the center of the overall ball (1), even when a liquid is being absorbed by the ball (1), and it allows a well-defined ball trajectory during play, when rolling over the surface as well as when passing above the surface. However, other shapes are possible like, for instance, elliptical or oval or any other random shape.

The mass of the core (2) of the ball, according to embodiments of this disclosure, may be determined taking into account the mass of the overall ball. For sports applications, in particular, a ball often needs to meet certain mass requirements, for instance, fall with a certain mass range between a minimum and maximum mass. The mass of the core (2) of the ball (1), according to embodiments of this disclosure, may be determined taking into account such mass range and taking into account the possible mass increase due to absorption of liquid by the ball. An example of such liquid is water but the disclosure is not limited hereto and the liquid may be, for example, an oil or gel. The core of the ball, according to embodiments of this disclosure, may have a mass between 20% and 90% of the total mass of an empty ball, i.e., a ball that has not yet absorbed any liquid. More preferably, the core of the ball has a mass between 30 and 80% of the total mass of an empty ball.

The size of the core (2) is in general defined by the maximum distance between the edges of that core or the diameter of the core $D_{core}$, in case of a spherical core of the ball and according to embodiments of this disclosure, may be determined taking into account the size/diameter of the overall ball and/or the mass requirements of the overall ball and/or the material properties of the core.

The outer surface of the core of the ball of this disclosure is substantially impermeable such that only a maximum of 15 m % of the absorbed liquid is able to pass through the outer surface of the core and enter the core, preferably a maximum of 5 m % of the total amount of absorbed liquid is able to pass through the outer surface of the core. In an embodiment of this disclosure, the outer surface of the core is impermeable, such that liquid absorbed by the overall ball is unable to pass through the outer surface of the core and thus enter the core.

The inner part of the core (2) of the ball (1) of this disclosure, i.e., the part between the outer surface of the core (2) and its center, is preferably made of a substantially impermeable material, although the disclosure is not limited thereto and the core may also be made of a porous or non-porous material.

The core (2) of the ball (1) may be made of a polymeric material, e.g., poly(lactic acid) (PLA) or acrylonitrile-butadiene-styrene copolymer (ABS) or blends containing different polymeric materials and/or polymeric materials with additional additives.

As an example, without being limited thereto, a core (2) of a ball (1), according to this disclosure, may have a spherical shape having a diameter $D_{core}$ in the range of 20 mm-65 mm; more specifically, in the range of 30 mm-60 mm and/or a mass in the range of 15 g to 200 g; more specifically, in the range of 50 g to 180 g. The core may be made of ABS or any other material considered suitable by the person skilled in the art. Such a ball is particularly suited for playing hockey on an artificial turf field.

Porous Structure

The ball (1), according to this disclosure, comprises a porous structure (3) encompassing the core (2). The porous structure (3) is delimited by an outer surface (5) and an inner surface (6). The porous structure (3) comprises a plurality of perforations (7) in its outer surface (5) allowing a liquid to pass through, i.e., to enter the porous structure (3) from outside the ball (1) or to exit the porous structure (3) from inside the ball (1). The porous structure (3) further comprises a plurality of hollow confined spaces in which a liquid can be at least temporarily stored. At least a part of the plurality of perforations (7) and at least a part of the plurality of hollow confined spaces are interconnected, such that a liquid entering the ball (1) through the perforations (7) may be absorbed and at least temporarily stored in the hollow confined spaces. The porous structure is preferably adapted to limit absorption of such liquid upon immersion of the ball in a liquid. The porous structure is preferably adapted in such a way that the alternation of the total mass of the ball (1) upon immersion of the ball in a liquid for a predetermined time period is not excessive. The porous structure is preferably adapted in such a way that the alternation of the total mass of the ball upon immersion of the ball in a liquid for a predetermined time period, for instance, during 30 minutes is at most, 35%; more preferably, at most 30%. Controlling the amount of liquid absorbed by the ball may also allow controlling the bouncing of the ball due to damping by liquid take-up.

In embodiments of this disclosure, the part of interconnected perforations (7) and hollow spaces may be adapted to allow a liquid to be absorbed with a predetermined absorption rate upon contact of the ball (1) with the liquid, e.g., upon immersion of the ball (1) in the liquid, and to be at least partly released with a predetermined desorption rate. In embodiments of this disclosure, the part of interconnected perforations (7) and hollow spaces are therefore adapted to control the amount of absorbed liquid by the porous structure upon immersion of the ball in a liquid during a predetermined time period and/or for controlling release of the absorbed liquid from the porous structure, e.g., after a ball rebound test. In embodiments of this disclosure, the interconnected perforations (7) and hollow spaces are adapted to control absorption of liquid by the ball and release of absorbed liquid from the ball; for instance, adapted in such a way that the absorbed liquid remains in the hollow confined spaces in the absence of forces exerted on the ball (1) (e.g., when the ball (1) is at rest) during a predetermined time period; for instance, during 30 minutes. In embodiments of this disclosure, the part of interconnected perforations (7) and hollow spaces are adapted in such a way that the at least a part of the absorbed liquid is released from the ball (1) upon exertion of significant external forces on the ball (1), e.g., upon dropping the ball (1) from a certain height, e.g., above 0.5 meter, and/or upon hitting the ball (1) during play. In embodiments of this disclosure, the control means for controlling the absorption of liquid by the ball and release of absorbed liquid from the ball, comprises channels interconnecting the porous structure perforations and the hollow confined spaces and the channels being adapted to perturbate the liquid flow between the porous structure perforations and the hollow confined spaces. In embodiments of this disclosure, without being limited thereto, the following parameters of the channels may be adapted to control such absorption and release: the diameter/size of the channel, the geometry, the length of the channel, and the number and size of fluid outlets in the channels.

a) Foam

In embodiments of a ball (1) according to this disclosure, the porous structure (3) comprises a foam structure (9), as is shown, for instance, in FIGS. 2-4 and FIGS. 8-9.

The outer surface (5) of the porous structure (3) comprises a plurality of perforations (7) through which a liquid can pass, i.e., enter or exit, the porous structure (3). The plurality of perforations (7) may be formed by a plurality of outer pores in the outer surface (5) of the foam as is shown, for instance, in FIG. 2 and FIG. 3. Alternatively, or in addition thereto, the plurality of perforations (7) may be complemented by a plurality of channels (10) extending through a part of the porous structure (3) and/or through a part of the foam structure as shown, for instance, in FIG. 4. Such channels interconnect the plurality of porous structure perforations and the plurality of hollow confined spaces. The plurality of channels (10) may extend between the outer surface (5) of the porous structure (3) and an intermediate inner part of the porous structure (3) (not shown), i.e., an inner part of the porous structure (3) between the outer (5) and inner surface (6) of the porous structure (3), or may fully extend between the outer (5) and inner surface (6) of the porous structure (3) as shown in FIG. 4. Such channels (10) may be adapted to control absorption of liquid by the ball and release of absorbed liquid from the ball, in particular, the conditions upon which liquid can be absorbed by the ball and released again, as such forming part of the control means of the ball.

The channels (10) may comprise one or more outlet openings, e.g., holes or ports, which are interconnected with the hollow confined spaces, such that liquid entering the porous structure (3) may pass through the holes of the channel toward the hollow confined spaces and such that liquid leaving the hollow confined spaces may pass through the holes of the channel toward the outside of the ball (1).

The inner part of the foam structure, i.e., the part of the foam structure between the inner and outer surface (5) of the foam structure, comprises a plurality of inner pores (11) that form a plurality of hollow confined spaces in which a liquid can be at least temporally stored. Preferably, at least a part of the inner pores are interconnected forming larger confined spaces in which a liquid can be at least temporally stored.

At least a part of the inner pores is connected with at least a part of the perforations (7) at the outer surface (5) of the porous structure, such that a liquid entering the porous structure (3) through the perforations (7) is able to enter the inner pores, be stored there, and exit the inner pores toward the perforations and eventually leave the ball (1). In FIG. 4, at least a part of the channels (10) in the porous structure are connected with at least a part of the inner pores of the foam structure.

Figure 2:
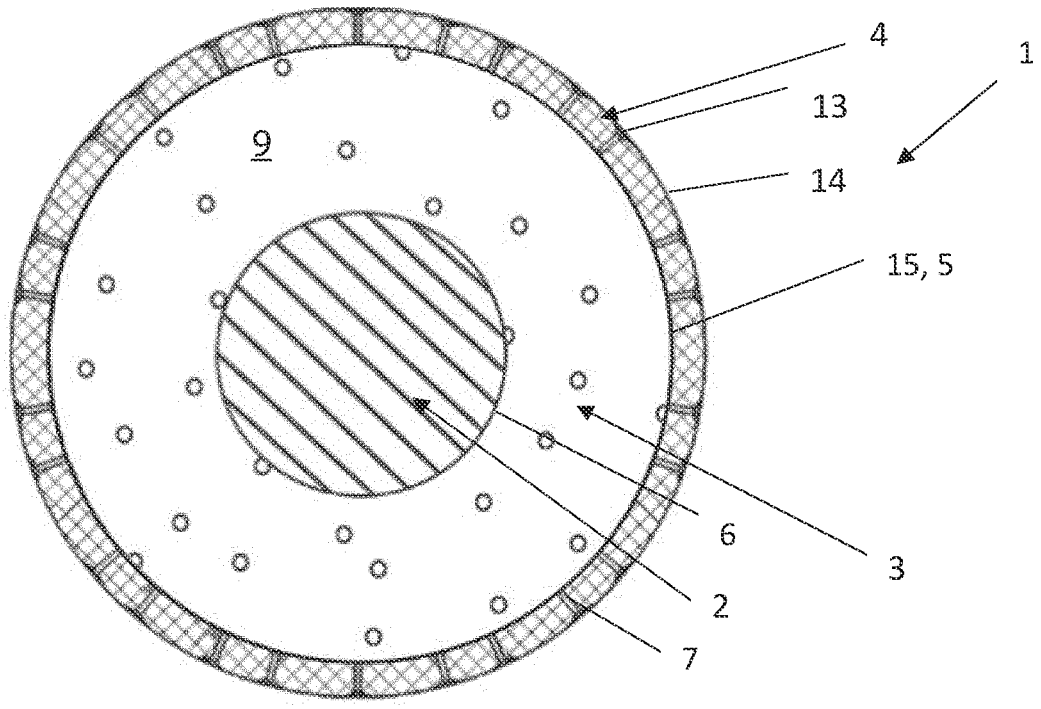
FIG. 2 is a cross sectional view of a three-layer ball, comprising a 1 piece foam structure, according to an embodiment of this disclosure.
Figure 3:
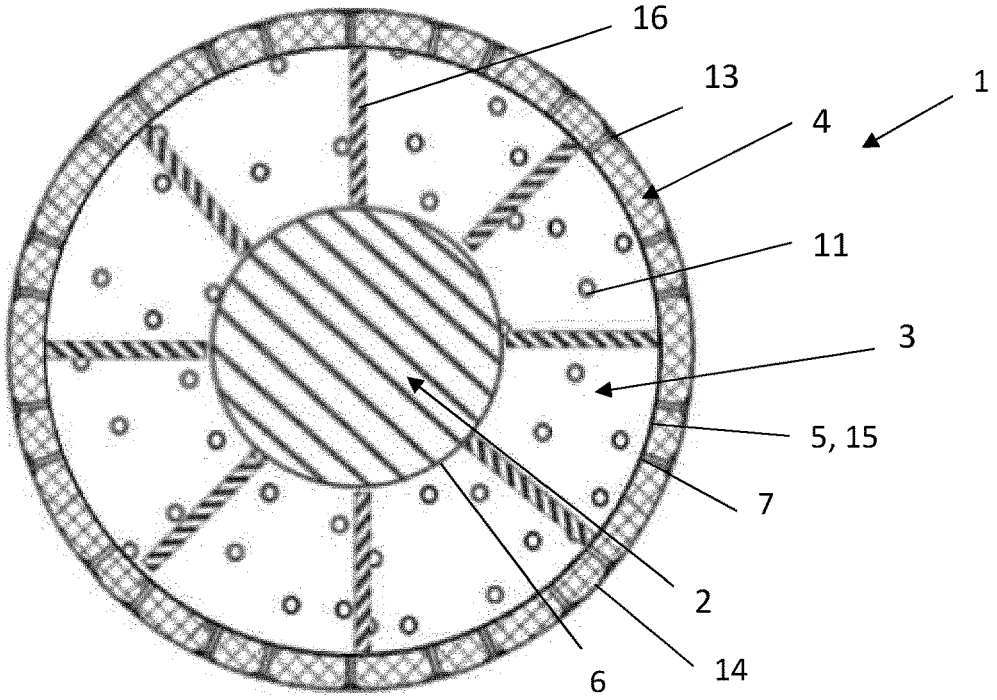
FIG. 3 is a cross sectional view of a three-layer ball, comprising a multiple-pieces foam structure, according to embodiments of this disclosure.
Figure 4:
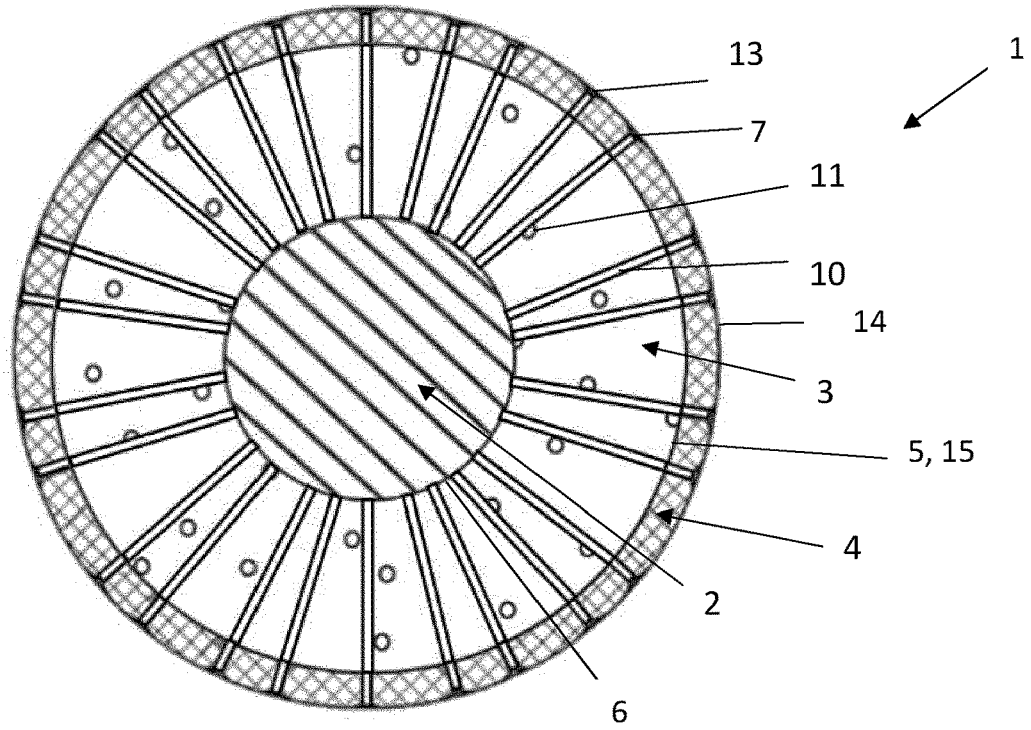
FIG. 4 is a cross sectional view of a three-layer ball, comprising a plurality of channels through the porous structure, according to embodiments of this disclosure.

The foam structure (9) may be made of one piece as is shown, for instance, in FIG. 2 or may be made of several pieces as is shown, for instance, in FIG. 3, leading to a multi-piece structure. In the latter case the different pieces may be at least partly interconnected as is shown in FIG. 4. Alternatively, the different pieces are not interconnected and are separated from each other with non-permeable pieces (16) as shown in FIG. 3.

The interconnection between the different pieces of foam may be realized by a number of channels (10) in the porous structure comprising one or more openings at least partly overlapping with inner pores of the foam structure. An interconnection is preferred because a liquid entering the porous structure can be more homogeneously divided inside the ball (1). This has the advantage that the point of gravity remains substantially the same, which is advantageous, in particular, for sports balls. Also exit of liquid benefits from this advantage.

The interconnection between the perforations (7) and the hollow confined spaces may be such that a liquid can pass more easily from the perforations (7) to the hollow confined spaces as vice versa, thereby realizing a faster absorption rate than release. For instance, the interconnection between the perforations (7) and the hollow confined spaces may be such that a liquid can pass from the perforations (7) to the hollow confined spaces upon immersion of the ball (1) within a liquid during a predetermined time period, while the liquid may only pass from the confined spaces to the perforations (7) during playing with the ball (1), for instance, upon hitting the ball (1) during play.

The porosity of the foam may be homogeneous, meaning that the porosity does not change throughout the structure, or heterogeneous, meaning that the porosity changes throughout the structure. The pore size is defined by the maximum distance between edges of a single pore. The porosity may vary with varying distance from the core (2), for instance, increase with increasing distance from the core (2) or decrease with decreasing distance from the core (2), benefiting from a possible variation of the overall size of the foam structure. Varying the porosity may allow controlling the liquid uptake and release efficiency. The foam structure may be a closed cell foam or an open cell foam. For hockey ball (1) application, the pore size may vary from 1 μm to 2 mm.

The interconnection between the perforations (7) and the hollow confined spaces may be such that the absorption and desorption of a liquid by the porous structure (3) is controlled. Controlling the absorption and desorption may be done in such a way that an absorption of the liquid by the ball (1) is faster than a desorption or vice versa. A faster absorption may allow a liquid to pass to the confined hollow spaces and be at least temporarily stored there. For instance, the interconnection between the perforations (7) and the hollow confined spaces may be such that a liquid can pass from the perforations (7) to the hollow confined spaces upon immersion of the ball (1) within a liquid during a predetermined time period, while the liquid may only significantly pass from the confined spaces to the perforations (7) during playing with the ball (1), for instance, upon hitting the ball (1) during play. Such a ball (1) may allow wetting the active zone of a playground, for instance, when playing hockey the zone where the ball (1) is present is sufficiently wet. To this end, the porosity of the foam structure may be changed with changing distance from the center of the ball (1), preferably with the larger pores in the region further away from the center of the ball (1). Alternatively, or in addition thereto, the channels in the porous structure and/or in the foam structure, may be shaped to ease absorption of a liquid and slow down desorption. To this end, the channel geometry can be adapted. Considering, for instance, a tubular geometry this implies that instead of using a constant diameter for the channel the diameter of the channel may be changed with changing distance from the beginning to the end of the channel, with the beginning defined as the part of the channel closest to the center of the ball (1) thus the core. The diameter of the channel may increase, for instance, with increasing or decreasing distance from the core (2), the increase being continuous or in discrete steps.

The porous structure (3) may be made of open cell polyurethane foam, woven fabrics or nonwovens (e.g., cotton) cork or hydrogels.

For hockey balls, the maximal thickness of foam structure is preferably between 5 and 50 mm.

b) Hollow Containers

Figure 5:
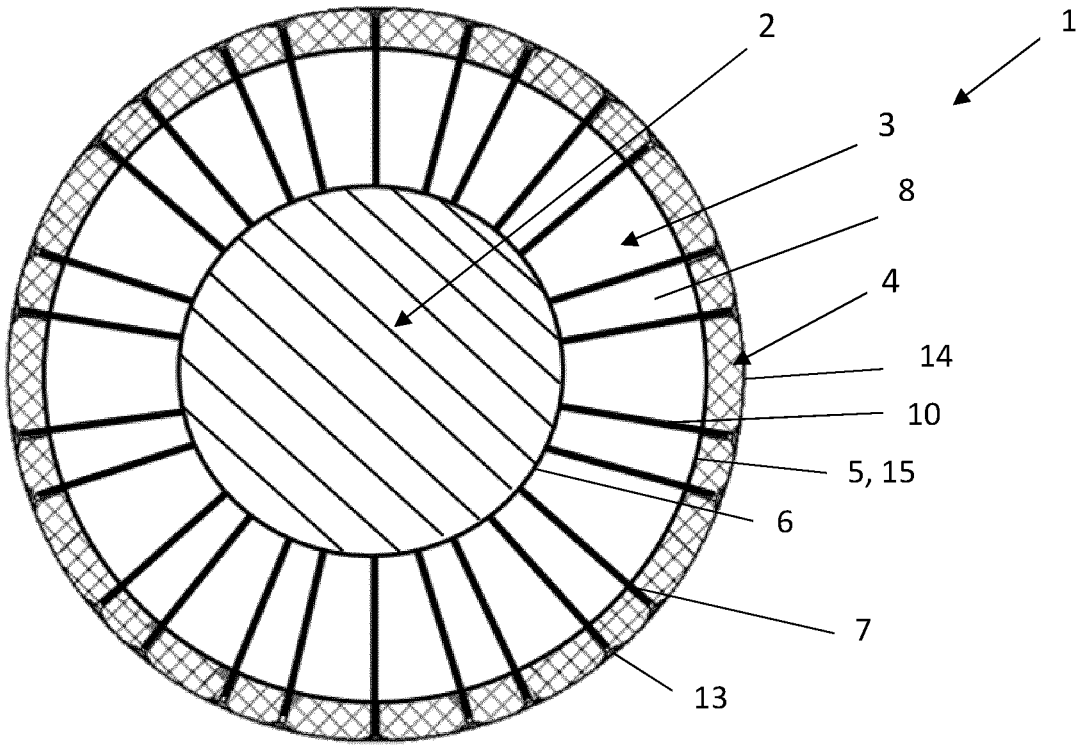
FIG. 5 is a cross sectional view of a three-layer ball, comprising a plurality of hollow containers, according to embodiments of this disclosure.
Figure 6:
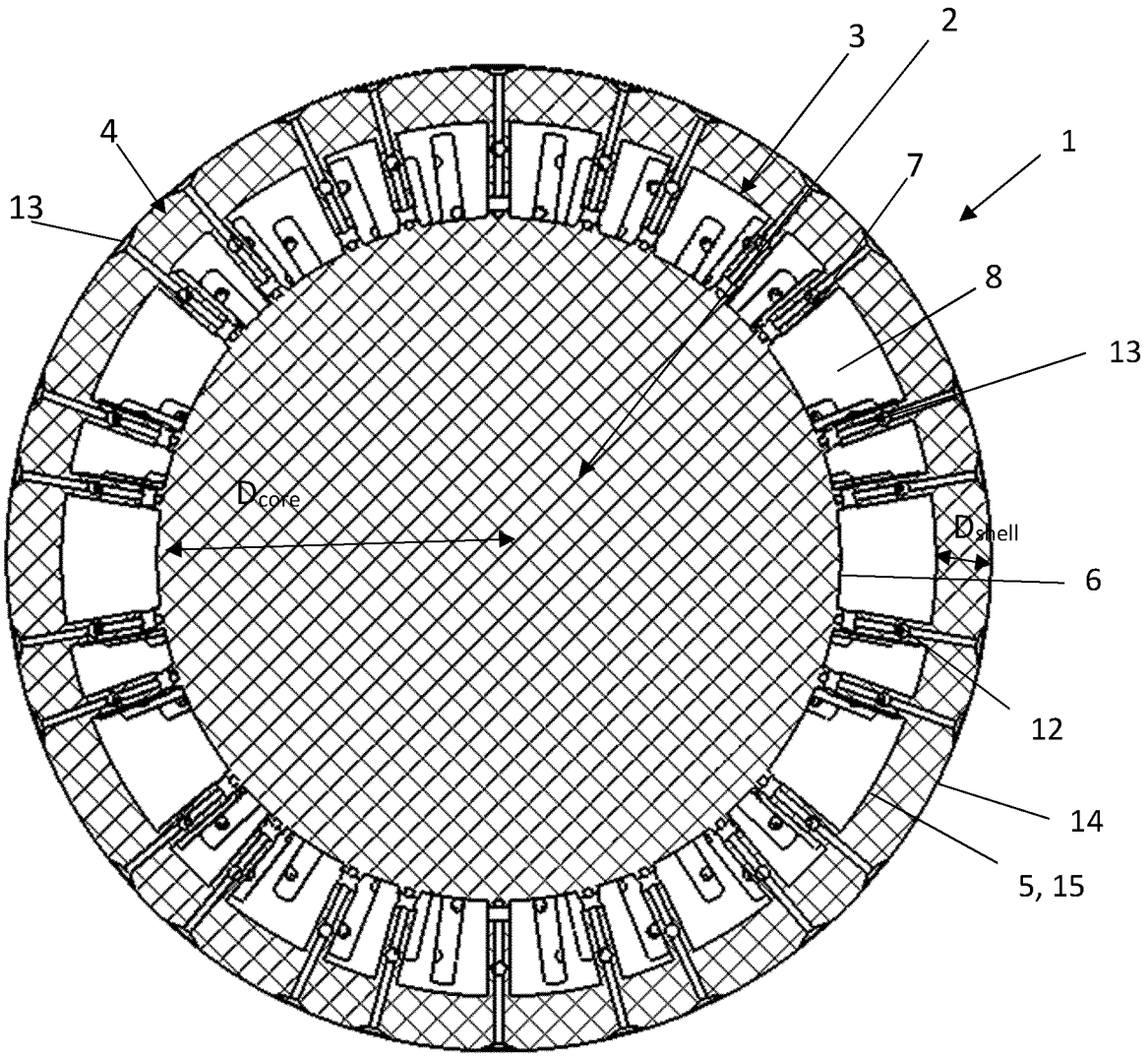
FIG. 6 shows a cross-sectional view of a three-layer ball, showing a number of design parameters of the ball according to embodiments of this disclosure.

In embodiments of a ball (1) according to this disclosure, the porous structure (3) comprises a plurality of hollow containers (8) as is shown, for instance, in FIG. 5 and FIG. 6. The plurality of hollow containers form the plurality of hollow confined spaces, in which a liquid entering the ball (1) because of outer contact of the ball (1) with such liquid can be temporally stored and the as such stored liquid can exit the ball (1) at a later stage when predetermined conditions are met.

The outer surface (5) of the porous structure (3) based on hollow containers (8) comprises a plurality of perforations (7) through which a liquid can enter or exit the porous structure (3) as is shown, for instance, in FIG. 10. The plurality of perforations may be formed by or extend in a plurality of channels extending through a part of the porous structure (3). The plurality of channels may extend between the outer surface (5) of the porous structure (3) and an intermediate inner part of this porous structure (3), i.e., an inner part of the porous structure (3) between the outer (5) and inner surface (6) of the porous structure (3) or may fully extend between the outer (5) and inner surface (6) of the porous structure (3). Such channels (10) may be adapted to control absorption of liquid by the ball and release of absorbed liquid from the ball, in particular, the conditions upon which liquid can be absorbed by the ball and released again, as such forming part of the control means of the ball.

Figure 7A:
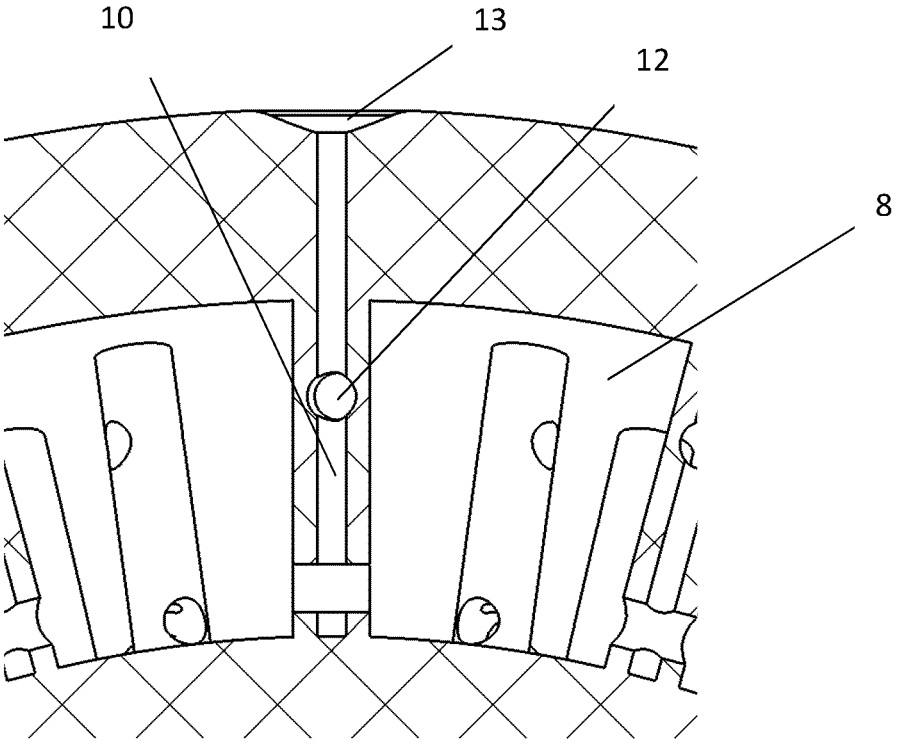
FIGS. 7A and 7B show a detail of a cross-sectional view of a three-layer ball, wherein the shell channels are respectively straight and vary with varying distance from the core, according to embodiments of this disclosure.
Figure 7B:
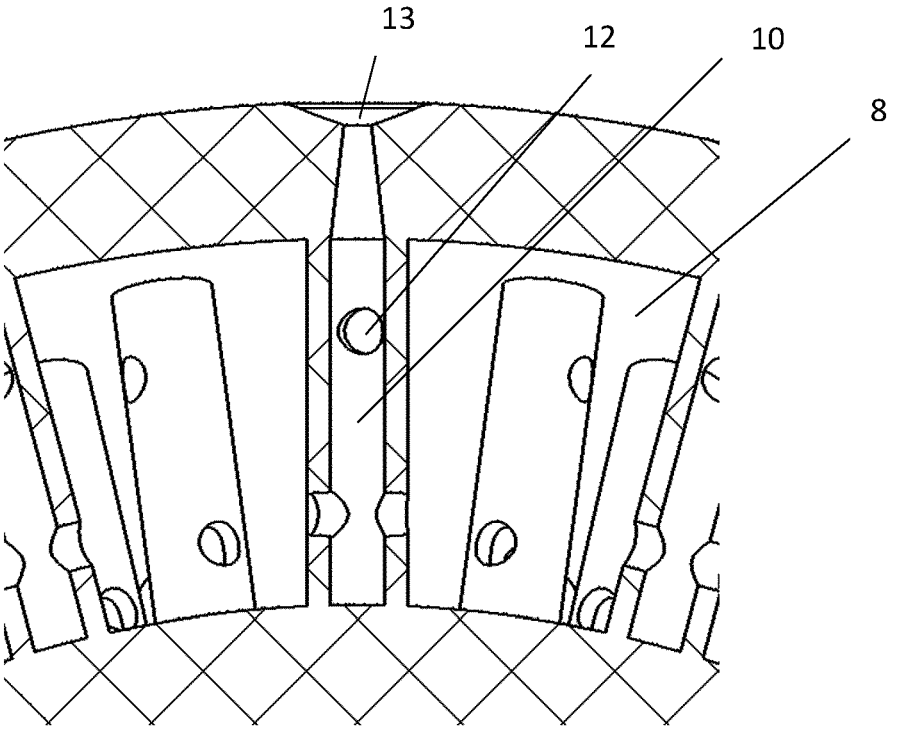

In view of liquid mobility at least a part of the hollow containers (8) is connected with at least a part of the channels (10), such that a liquid entering the porous structure (3) through the channels is able to enter the hollow containers and be at least temporarily stored therein. Similarly such connection is relevant for exit of liquid. The plurality of hollow containers may be interconnected or not and be of various shapes (e.g., trapezoid prism) and volumes (e.g., 500 $mm^3$). The interconnection between different hollow containers may comprise, for instance, transversal connections, i.e., connections in a direction as shown in FIG. 7. An interconnection between at least a part of the different containers is preferred as this may result in a more homogeneous distribution of the liquid inside the ball (1). The channels may comprise one or more outlet openings or holes (12) that are connected and/or overlap at least partly with one or more of the hollow containers as shown in FIG. 7. These holes, as located, for instance, on the circumferential surface of the channels, have a maximal size between 0.1 and 1 mm. However, any other connection between the channels and the hollow containers may be used allowing a liquid to pass from channels to hollow containers and back throughout the complete porous structure.

The interconnection between the perforations (7) defining the outside of the porous structure and the hollow containers defining the inside of the porous structure may be such that the absorption and desorption of a liquid by the porous structure is controlled. Controlling the absorption and desorption may be done in such a way that absorption of the liquid by the ball (1) is faster than desorption or vice versa. A faster absorption may allow a liquid to pass to the confined hollow spaces and be at least temporarily stored there. For instance, the interconnection between the perforations (7) and the hollow confined spaces may be such that a liquid can pass from the perforations (7) to the hollow confined spaces upon immersion of the ball (1) within a liquid during a predetermined time period, while the liquid may only significantly pass from the confined spaces to the perforations (7) during playing with the ball (1), for instance, upon hitting the ball (1) during play. Such a ball (1) may allow wetting the active zone of the playground, for instance, when playing hockey, allowing the zone where the ball (1) is present to be sufficiently wet. To this end, the channel geometry can be adapted. Considering, for instance, a tubular geometry this implies that instead of using a constant diameter for the channel in the porous structure the diameter of the channel in the porous structure may be changed with changing distance from the beginning to the end of the channel, with the beginning defined as the part of the channel closest to the center of the ball (1) thus the core (2). The diameter of the channel may increase, for instance, with increasing or decreasing distance from the core (2), the increase being continuous or in discrete steps.

Shell

The ball (1), according to this disclosure, comprises a shell (4) covering a porous structure (3) as shown in FIG. 3-FIG. 9. The shell (4) is delimited by an outer surface (14) in contact with the environment and an inner surface (15); the inner surface (15) may be in contact with the outer surface (5) of the porous structure. The outer surface of the shell comprises a plurality of shell perforations extending between a shell outer opening in the outer shell surface and a shell inner opening in the shell inner surface. The plurality of shell perforations (13) allows a liquid to enter the ball (1) and pass through the shell (4) of the ball (1) toward the porous structure. Also the reverse movement of liquid exit is possible. At least a part of the plurality of shell perforations (13) is interconnected with at least a part of the perforations (7) of the porous structure, allowing a liquid to pass from the shell perforations through the porous structure perforations (7) to the hollow confined spaces and reversely.

The shell (4) of the ball (1) may be made of a polymeric material, e.g., PLA or ABS or polyolefin (e.g., polyethylene or polypropylene) or blends containing different polymeric materials and/or polymeric materials with additional additives.

The shell perforations (13) may have any shape or geometry considered suitable by the person skilled in the art. Preferably, the shell perforations (13) are shaped such that absorption and desorption of a liquid by the shell (4) is controlled. As an example, controlling the absorption and desorption of a liquid may be done in such a way that absorption of a liquid by the ball (1) is faster than desorption or vice versa. A faster absorption may allow a liquid to pass through the shell perforations to the confined hollow spaces and be at least temporarily stored there. For instance, the interconnection between the shell perforations (13) and the hollow confined spaces may be such that a liquid can pass from the shell perforations to the perforations of the porous structure to the hollow confined spaces upon immersion of the ball (1) within a liquid during a predetermined time period, while the liquid may only pass significantly from the confined spaces back to the shell (4) during playing with the ball (1), for instance, upon hitting the ball (1) during play. Such a ball (1) may allow wetting of the active zone of a playground, for instance, when playing hockey the zone where the ball (1) is present on the play surface is sufficiently wet. To this end, the diameter of the shell perforations may be changed with changing distance through the shell. The diameter of the shell perforations may increase, for instance, with increasing or decreasing distance from the porous structure (3) or the center of the ball (1). The increase may be continuous or in discrete steps. The shell perforations may be formed by a dimple, for instance, in the case of sports ball (1). The shell perforations may be formed by a dimple followed by a shell channel with varying geometry interconnected to the dimple thereby allowing for a liquid passage through the shell (4). Such shell channels may be provided between the shell outer and shell inner opening interconnecting the shell perforations and the porous structure perforations. The shell channels may form part of the control means for controlling absorption of liquid by the ball and release of liquid from the ball.

At least a part of the shell perforations are interconnected with at least a part of the perforations of the porous structure (3), allowing a liquid to pass from the shell (4) through the perforation of the porous structure (3) to the hollow confined spaces or reverse. The inner opening of the shell perforation may therefore be positioned in a specific pattern with respect to at least one of the perforations of the porous structure, preferentially in close vicinity or even overlapping with at least one of the perforations of the porous structure. However, any other connection considered suitable by a person skilled in the art is possible. A specific example is given in FIG. 8 with the perforations in the porous structure not being in direct contact with the shell perforations, but separated from each other with a perforated foil between them and with the perforations of the porous structure not being aligned with the shell perforations. Providing such a foil allows the liquid flow to be controlled, for instance, delayed, with the liquid also additionally contained in the region between the shell and the perforated foil.

The shell thickness ($D_{shell}$ in FIG. 6) is preferably smaller than the thickness of the porous structure (3) and may be varied as considered suitable by the person skilled in the art. The shell thickness is preferably varied between 1 and 20 mm to allow for a sufficient material strength and to enable a variation of shell perforation channel lengths, thereby controlling the absorption and release of liquid by the ball. For hockey balls this size range is specifically suited. The number of shell perforations may be varied as considered suitable by the person skilled in the art. For hockey balls one can specifically have a number of shell perforations as high as the number of dimples. The liquid uptake and release is directly related to the number of shell perforations as it is respectively the first and last contact with the outer environment.

Perforated Foil

Figure 8:
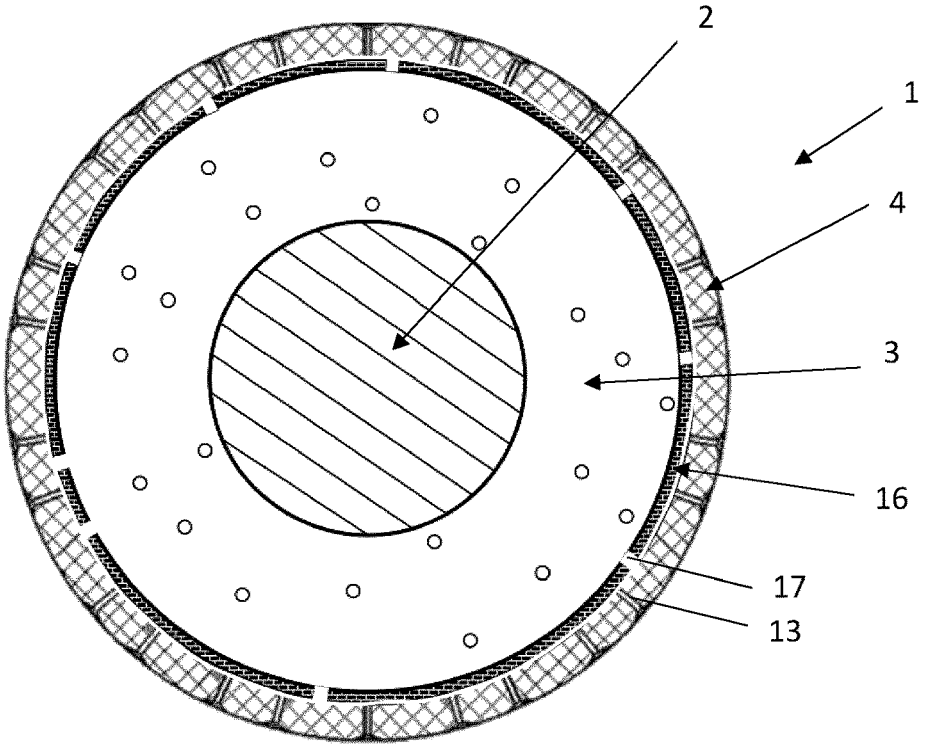
FIG. 8 shows a three-layer ball, comprising a perforated foil between the shell and the porous structure according to embodiments of this disclosure.
Figure 9A:
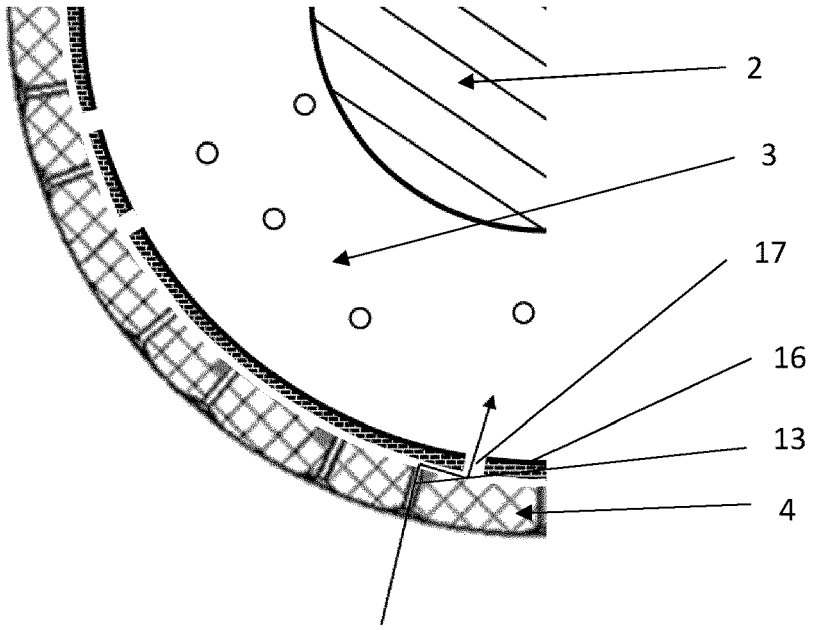
FIGS. 9A and 9B show a detail of a three-layer ball of FIG. 8, showing the perturbated liquid flow path upon absorption, respectively release of the liquid from the ball.
Figure 9B:
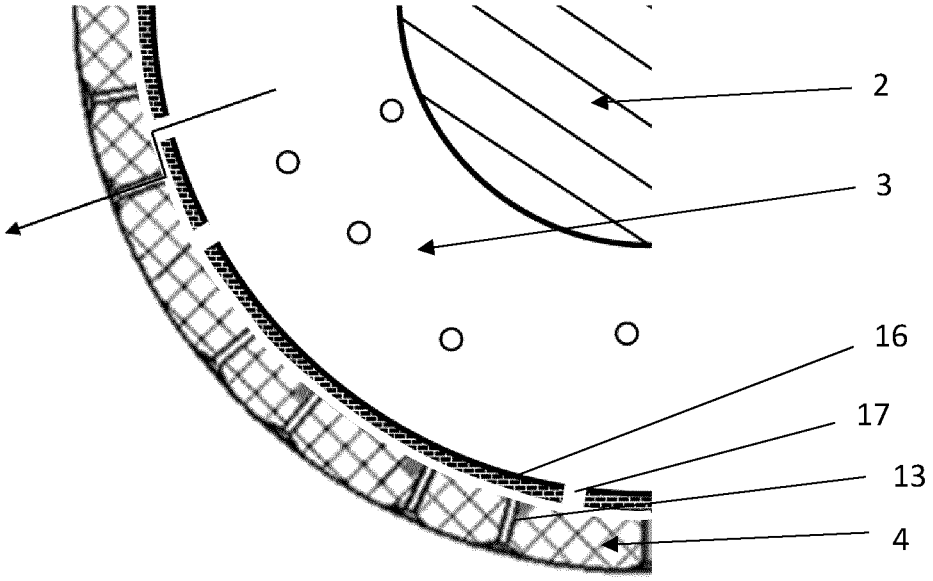

The ball, according to embodiments of this disclosure, comprises a perforated foil between the shell and the porous structure as shown in FIG. 8 and FIG. 9. The perforated foil can be adapted to perturbate the liquid flow from the shell toward the porous structure and vice versa, thereby providing part of the structural control means of the ball for controlling absorption and release of liquid by and from the ball.

Preferably, the perforated foil is not fixated to the shell nor to the inner porous structure but loosely fits in a narrow space between them. In such an embodiment, the foil can be pushed back and forward when fluid is being absorbed or released, thereby creating additional resistance for the liquid to enter or leave the porous structure.

More preferably, the foil perforations are not aligned or do not completely overlap with the shell perforations and perforations of the porous structure, again creating additional resistance for the liquid to enter or leave the porous structure and as such controlling the absorption and release of liquid by and from the ball.

The thickness of the foil is preferably between 50 and 200 μm.

The foil can be made of a polymeric material such as polyethylene.

The size of the foil perforations is preferably between 0.5 and 2 mm, preferably around 1 mm.

The distance between the foil perforations is preferably between 1 and 4 cm.

3-Layer Ball

A ball (1), according to embodiments of this disclosure, may be a 3-layer ball as shown in FIGS. 2-7, comprising a core (2), a porous structure (3) encompassing the core (2), and a shell (4) covering the porous structure (3). A number of design parameters exist in order to control the absorption, e.g., uptake rate of liquid by the ball (1), e.g., the conditions upon which liquid can be absorbed by the ball (1), the amount of liquid that can be absorbed and stored by the ball (1), the release rate of liquid by the ball (1) and the conditions upon which liquid can be released by the ball (1). Such design parameters are, without being limited thereto, the following: (i) the diameter of the core; (ii) the core filling degree as defined as the m % of material present in the core (e.g., between 5 and 100%); (iii) the materials types used for the different layers of the ball (1); (iv) perforations in the outer surface (5) of the porous structure having a variable number and size; (v) the flexibility to have one piece or multi-pieces of foam as porous structure (3) with a certain inner pore size either homogeneously or heterogeneously distributed; (vi) a porous structure based on hollow containers comprising channels with variable number and geometry; (vii) the channels having a variable length and size (e.g., diameter) profile; (viii) channels connecting the porous structure perforations and the hollow confined spaces (ix) the channels having a number of holes in their circumferential surface. (x) the diameter of the shell perforations at the outer surface (e.g., 0.2 to 0.6 mm) (xi) the geometry of the shell channels; (xii) the shell thickness; (xiii) the number of shell perforations; (xiv) the presence of perforated foil between the shell and the porous structure, the number of perforations in the perforated foil; (vi) the positioning of the latter perforations with respect to the shell perforations; (xv) channels connecting the shell perforations with the porous structure perforations.

For hockey ball applications the diameter of the core of the ball (1) is preferably between 20 mm and 65 mm and/or the core filling degree is preferably between 5% and 100% and/or the diameter of the porous structure channel preferably varying between 0.3 mm and 1 mm and/or the number of holes of the porous structure channels preferably varies between 1 and 3, and/or the diameter of the shell perforations is preferably between 0.2 and 0.6 mm and/or the shell thickness is preferably between 1 mm and 20 mm, the length of the shell perforations/shell channels is preferably between 1 mm and 20 mm, the perforated foil layer, if any, preferably has a thickness between 50 and 200 μm with a perforation diameter between 0.5 and 2 mm and a distance between the perforations in the range of 1 to 4 cm.

For hockey ball applications, the control means of the ball are preferably adapted to allow a m % absorption between 10 and 35 m % upon immersion of the ball in a reservoir of liquid during 15 to 60 minutes; more preferably, between 20 and 40 minutes. A m % absorption is defined as the mass increase of the ball as a result of absorption of liquid by the ball upon contact of the ball with the liquid during a predetermined time period (i.e., the mass of the absorbed liquid) compared to the mass of the dry ball, i.e., the mass of the ball without liquid. For hockey ball applications, the control means of the ball are preferably adapted to allow a m % release of liquid between 0.1 and 15 m % upon a regulated ball rebound test according to EN12235 (2013); more preferably, between 1 and 10 m %. A m % release of liquid is defined as the mass of liquid leaving the ball, e.g., upon a regulated ball rebound test according to EN12235 (2013), compared to the mass of liquid absorbed by the ball upon contact of the ball with the liquid during a predetermined time period, e.g., upon immersion of the ball in the liquid during a predetermined time period.

The balls, according to embodiments of this disclosure, can be fabricated via different processing techniques. For example, 3D printing or additive manufacturing can be considered. Alternatively, injection and rotational molding can be considered or foam casting or extrusion. Also combinations of these processing techniques can be used. Several halves may be made and the connection can be facilitated by, for instance, gluing, friction welding or heating.

Examples

Embodiments of a ball (1), according to this disclosure, will be described to illustrate certain advantages of this disclosure. Such advantages are illustrated by the variation of design parameters, with for illustration purposes the focus on the variation of one such parameter to highlight the effect. The scope of the disclosure is however not limited to these embodiments.

For illustration purposes the multilayer balls with a porous structure based on hollow containers are obtained as one part by 3D printing in spherical shape, using commercially available configurations. The multilayer balls based on foams are for illustration purposes also 3D printed but in two halves that are connected to each other by a glue. The number of outer perforations is fixed at 242 in line with the number of dimples in a conventional thus currently used hockey ball. The filler degree of the core is also fixed at 40%. The overall diameter of the ball is 72 mm in each case.

The performance of the exemplary balls is evaluated regarding both the capacity of liquid absorption and desorption, selecting for illustration purposes tap water as liquid. For the absorption of liquid, focus is on the increase in mass after 30 minutes of immersion of a dry ball in a reservoir of liquid. The performance is evaluated based on the mass percentage of liquid absorption minimizing experimental error by reporting an average value based on a three time testing procedure. A m % absorption between 10 and 35 m % after immersion of the ball in a reservoir of liquid is preferred for hockey ball applications. For the desorption of liquid, focus is on the mass % loss (so with respect to the absorbed amount; again average value for a three time testing procedure) after a regulated ball rebound test. The vertical ball rebound is measured by releasing a ball from 2 meter height and measuring acoustically its rebound on a surface. In this case the surface is a polyethylene 7000 dtex carpet laid on a 15 mm layer, i.e., a layer of styrene-butadiene rubber particles bounded by a polyurethane glue. The method used is the EN12235 (2013). A m % loss between 0.1 and 15 m % preferably between 1 and 10 m % after a ball drop is preferred for hockey ball applications. The presented results are also discussed in view of these desired ranges for hockey ball applications but the main purpose is to illustrate the effect on the trends in absorption and desorption capacity, explaining why the reported m % values are not necessarily falling in these specific desired ranges for hockey ball applications.

Experiment 1: Variation of the size of the shell perforations

| Number | Mass dry ball (g) | Mass after 30 min immersion (g) | Liquid absorption (m %) | Mass after ball drops (g) | Liquid desorption (m %) |
|---|---|---|---|---|---|
| 8 | 108.6 | 131.9 | 21 | 122.8 | 39 |
| 9 | 119.3 | 122.3 | 3 | 120.1 | 73 |
| 10 | 112.9 | 114.2 | 1 | 113.1 | 85 |

Balls 8-10 are 3-layer balls as shown in FIG. 6-7. The mass of the empty balls 8-10, so without having the liquid absorbed, are respectively 108.6 g, 119.3 g and 112.9 g. The core has a spherical shape with a diameter of 50 mm. The shell has a thickness of 4 mm and porous structure a thickness of 7 mm. The tubular channels in the porous structure comprise 2 holes that are connected to neighboring hollow confined spaces of the porous structure. Balls 8-10 are 3D printed and are made of PLA. The porous structure and the shell comprise a number of straight channels having a constant size/diameter of 0.6 mm (ball number 8), 0.4 mm (ball number 9) and 0.2 mm (ball number 10). Hence, the size of the shell perforations are respectively 0.6 mm, 0.4 mm and 0.2 mm. Immersion of balls 8-10 in water for 30 minutes results in a mass increase of the ball due to absorption of water of respectively 21%, 3% and 1%. A mass decrease of the ball due to release of liquid of respectively 39%, 73% and 85% is reported, highlighting the relevance of the diameter of the shell perforations.

Experiment 2: Variation of the thickness of the shell

| Number | Mass dry ball (g) | Mass after 30 min immersion (g) | Liquid absorption (m %) | Mass after ball drops (g) | Liquid desorption (m %) |
|---|---|---|---|---|---|
| 18 | 133.2 | 169.3 | 27 | 157.0 | 34 |
| 19 | 135.9 | 162.7 | 20 | 153.2 | 35 |

Balls 18-19 are 3-layer balls and are shown based on the concept in FIGS. 6-7. The mass of the dry or empty balls 18-19 are respectively 133.2 g and 135.9 g. The core has a spherical shape with a diameter of respectively 50 mm. The shell thicknesses are respectively 4 and 6 mm. The corresponding porous structures have a thickness of 7 and 5 mm. The tubular channels in the porous structure comprise 1 hole that is connected to neighboring hollow confined spaces of the porous structure. Balls 18-19 are 3D printed and are made of ABS. The porous structure and the shell comprise a number of channels. The shell channels have a variable diameter from 0.4 mm (toward center of ball) to 0.8 mm (toward outer part of ball) in a linear manner. The smallest diameter of the shell channel is also the diameter of the channel in the porous structure. Immersion of balls 18-19 in water for 30 minutes results in a mass increase of the ball due to absorption of water of respectively 27% and 20%, highlighting the relevance of the variation of the thickness of the shell. A mass decrease of the ball due to release of liquid of respectively 34% and 35% is reported.

Experiment 3: Variation of geometry of channels in the shell and porous structure

| Number | Mass dry ball (g) | Mass after 30 min immersion (g) | Liquid absorption (m %) | Mass after ball drops (g) | Liquid desorption (m %) |
|---|---|---|---|---|---|
| 9 | 119.3 | 122.3 | 3 | 120.1 | 73 |
| 11 | 115.5 | 149.6 | 30 | 147.2 | 7 |
| 12 | 110.3 | 149.6 | 36 | 126.4 | 59 |

Balls 9, 11 and 12 are 3-layer balls and are based on the concept in FIGS. 6-7. The mass of the balls 9, 11 and 12 are respectively 119.3 g, 115.5 g and 110.3 g. The core has a spherical shape with a diameter of 50 mm. The shell has a thickness of 4 mm and the porous structure has a thickness of 7 mm. The tubular channels in the porous structure comprise 2 holes that are connected to neighboring hollow confined spaces of the porous structure. Balls 9, 11 and 12 are 3D printed and are made of PLA. The porous structure and the shell comprise a number of channels with variation in the tubular geometry within the shell. Ball 9 has a constant shell diameter of 0.4 mm (straight channel). Ball 11 has shell channels with a variable diameter from 0.4 mm (toward center of ball) to 0.8 mm (toward outer part of ball) in a linear manner. For ball 12 this is the reverse so from 0.8 to 0.4 nm. The smallest diameter of the shell channel is also the diameter of the channel in the porous structure. Immersion of balls 9, 11 and 12 in water for 30 minutes results in a mass increase of the ball due to absorption of water of respectively 3%, 30% and 36%. A mass decrease of the ball due to release of liquid of respectively 73%, 7% and 59% is reported, highlighting that with the appropriate diameter variation one can tune the liquid absorption and desorption rate.

Experiment 4: Variation of the number of holes in channels

| Number | Mass dry ball (g) | Mass after 30 min immersion (g) | Liquid absorption (m %) | Mass after ball drops (g) | Liquid desorption (m %) |
|---|---|---|---|---|---|
| 17 | 133.5 | 176.6 | 32 | 174 | 6 |
| 18 | 133.2 | 169.3 | 27 | 157 | 34 |

Balls 17 and 18 are 3-layer balls and are shown based on the concept in FIGS. 6-7. The mass of the balls 17 and 18 are respectively 133.5 g and 133.2 g. The core has a spherical shape with a diameter of respectively 50 mm. The shell has a thickness of 4 mm and the thickness of the porous structure is 7 mm. The tubular channels in the porous structure comprise respectively 2 and 1 holes that are connected to neighboring hollow confined spaces of the porous structure. Balls 17 and 18 are 3D printed and are made of ABS. The shell comprises a number of channels having a variable diameter from 0.4 mm (toward center of ball) to 0.8 mm (toward outer part of ball) in a linear manner. The smallest diameter of the shell channel is also the diameter of the channel in the porous structure. Immersion of balls 17 and 18 in water for 30 minutes results in a mass increase of the ball due to absorption of water of respectively 32% and 27%. A mass decrease of the ball due to release of liquid of respectively 6% and 34% is reported.

| Experiment 5: Variation of the core diameter | | | | | |
|---|---|---|---|---|---|
| Number | Mass dry ball (g) | Mass after 30 min immersion (g) | Liquid absorption (m %) | Mass after ball drops (g) | Liquid desorption (m %) |
| 13 | 133.2 | 163.4 | 23 | 155.6 | 26 |
| 14 | 146.6 | 158.7 | 9 | 156.8 | 15 |

Balls 13-14 are 3-layer balls and are shown based on the concept in FIGS. 6-7. The mass of the balls 13-14 are respectively 133.2 g and 146.6 g. The core has a spherical shape with a diameter of respectively 50 and 60 mm. The shell has a thickness of 4 mm so that the corresponding thicknesses of the porous structure are 7 and 2 mm. The channels in the porous structure comprise 2 holes that are connected to neighboring hollow confined spaces of the porous structure. Balls 13-14 are 3D printed and are made of ABS. The porous structure and the shell comprise a number of straight channels having a diameter of 0.6 mm. Immersion of balls 13-14 in water for 30 minutes results in a mass increase of the ball due to absorption of water of respectively 23% and 9%. A mass decrease of the ball due to release of liquid of respectively 26% and 15% is reported, highlighting the relevance of the diameter of the core.

| Experiment 6: Variation of the porous structure: hollow containers versus foam | | | | | |
|---|---|---|---|---|---|
| Number | Mass dry ball (g) | Mass after 30 min immersion (g) | Liquid absorption (m %) | Mass after ball drops (g) | Liquid desorption (m %) |
| 8 | 108.6 | 131.9 | 21 | 122.8 | 39 |
| 21 | 122 | 149.1 | 22 | 148.2 | 4 |

Ball 8 is a 3-layer ball based on the concept in FIGS. 6-7. The mass of the ball 8 is 108.6 g. The core has a spherical shape with a diameter of 50 mm. The shell has a thickness of 4 mm and the porous structure has a thickness of 7 mm. The tubular channels in the porous structure comprise 2 holes that are connected to neighboring hollow confined spaces of the porous structure. Ball 8 is 3D printed and is made of PLA. The porous structure and the shell comprise a number of channels with variation in the tubular geometry within the shell. Ball 8 has a constant shell diameter of 0.6 mm (straight channel). Ball 21 is a 3-layer ball based on the concept in FIG. 2 with a single piece polyurethane foam with homogenously distributed pores with an average size between 1 μm and 0.1 mm and the same core as ball 8. Also the shell is the same as for ball 8 so that the size of the porous structure is also the same. The mass of ball 21 is 122 g. Immersion of balls 8 and 21 in water for 30 minutes results in a mass increase of the ball due to absorption of water of respectively 21% and 22%. A mass decrease of the ball due to release of liquid of respectively 39% and 4% is reported, highlighting the relevance of the porous structure type.

| Experiment 7: Variation of the porous structure: effect of perforated foil between the shell and the porous structure | | | | | |
|---|---|---|---|---|---|
| Number | Mass dry ball (g) | Mass after 30 min immersion (g) | Liquid absorption (m %) | Mass after ball drops (g) | Liquid desorption (m %) |
| 37 | 115.4 | 174.3 | 51 | 162.0 | 21 |
| 38 | 119.6 | 174.9 | 46 | 169.7 | 9 |

Ball 37 is a 3-layer ball based on the concept in FIG. 2 with a single piece polyurethane foam with homogenously distributed pores with an average size between 1 μm and 0.1 mm. The core has a spherical shape with a diameter of 50 mm. The shell has a thickness of 4 mm and the porous structure has a thickness of 7 mm. Ball 37 is 3D printed and is made of ABS. The shell comprises a number of straight channels having a constant size/diameter of 0.6 mm. Ball 38 is the extended version of ball 37 having an additional polyethylene foil of thickness 60 μm with perforations of 1 mm diameter at a 1 cm distance (so 4 per $cm^2$) provided between the shell and polyurethane foam, as shown in FIG. 8. The foil perforations are not aligned with the perforations in the shell, i.e., they do not overlap. Immersion of balls 37 and 38 in water for 30 minutes results in a mass increase of the ball due to absorption of water of respectively 21% and 22%. A mass decrease of the ball due to release of liquid of respectively 39% and 4% is reported, highlighting the relevance of the film layer with a controlled perforation pattern to control the liquid passage.

| Experiment 8: Variation of size of the foil perforations | | | | | |
|---|---|---|---|---|---|
| Number | Mass dry ball (g) | Mass after 30 min immersion (g) | Liquid absorption (m %) | Mass after ball drops (g) | Liquid desorption (m %) |
| 43 | 119.0 | 175.3 | 47 | 171.6 | 7 |
| 44 | 118.1 | 172.5 | 46 | 166.7 | 11 |

Ball 43 is a 3-layer ball based on the concept in FIG. 8 with a polyurethane foam as 1 piece porous structure with homogenously distributed pores with an average size between 1 μm and 0.1 mm. The core has a spherical shape with a diameter of 50 mm. The shell has a thickness of 4 mm and the porous structure has a thickness of 7 mm. Ball 43 is 3D printed and is made of ABS. The shell comprises a number of straight channels having a constant size/diameter of 2 mm. It also has a polyethylene perforated foil of thickness 60 μm with perforations of 1 mm diameter that are at 1 cm distance (so 4 per $cm^2$). The foil perforations are not aligned with the perforations in the shell. Ball 44 is comparable to ball 43 but the diameter of the foil perforations is 5 mm. Immersion of balls 43 and 44 in water for 30 minutes results in a mass increase of the all due to absorption of water of respectively 47% and 46%. A mass decrease of the ball due to release of liquid of respectively 7% and 11% is reported, highlighting the relevance of the foil/film with a controlled perforation pattern to control the liquid passage.

| Experiment 9: Variation of the foam type | | | | | |
|---|---|---|---|---|---|
| Number | Mass dry ball (g) | Mass after 30 min immersion (g) | Liquid absorption (m %) | Mass after ball drops (g) | Liquid desorption (m %) |
| 38 | 119.6 | 174.9 | 46 | 169.7 | 9 |
| 48 | 112.9 | 146.9 | 30 | 144.3 | 8 |

Ball 38 is a 3-layer ball with a polyurethane foam as a single piece porous structure with homogenously distributed pores with an average size between 1 μm and 0.1 mm. The core has a spherical shape with a diameter of 50 mm. The shell has a thickness of 4 mm and the porous structure has a thickness of 7 mm. Ball 38 is 3D printed and is made of ABS. The shell comprises a number of straight channels having a constant size/diameter of 0.6 mm. It also contains a polyethylene foil/film layer of thickness 60 μm with perforations of 1 mm diameter that are at 1 cm distance (so 4 per $cm^2$) consistent with FIG. 8. The foil perforations are not aligned with the perforations in the shell. Ball 48 is comparable to ball 38, but the foam is a 3D woven nylon structure with a higher maximum pore size of 1 mm. Immersion of balls 38 and 48 in water for 30 minutes results in a mass increase of the ball due to absorption of water of respectively 21% and 22%. A mass decrease of the ball due to release of liquid of respectively 39% and 4% is reported, highlighting the relevance of the foam type.

The invention claimed is:

1. A ball comprising a core, wherein the core comprises a substantially impermeable outer surface, the ball further comprising a porous structure encompassing the core, the porous structure being delimited by an outer surface and an inner surface, the outer surface of the porous structure comprising a plurality of perforations, the porous structure comprising a plurality of hollow confined spaces, with at least a part of the plurality of porous structure perforations and at least a part of the plurality of hollow confined spaces being interconnected, the ball further comprising a shell encompassing the porous structure, the shell being delimited by a shell outer surface and a shell inner surface, the shell comprising a plurality of shell perforations with at least a part of the plurality of shell perforations extending between a shell outer opening in the shell outer surface and a shell inner opening in the shell inner surface, and with at least part of the plurality of shell perforations being interconnected with the porous structure perforations, the interconnected plurality of shell perforations, porous structure perforations and hollow confined spaces defining a plurality of liquid passages allowing a liquid to be absorbed by the hollow confined spaces upon contact of the ball with the liquid, the ball further comprising control means for controlling absorption of the liquid by the ball and/or for controlling release of the absorbed liquid from the ball, wherein said control means at least comprises a shell channel provided between the shell outer opening and shell inner opening interconnecting the shell perforations and the porous structure perforations.

2. The ball of claim 1, wherein the porous structure comprises a foam structure.

3. The ball of claim 2, wherein the foam structure comprises pores with a maximum size of between 1 μm and 2 mm.

4. The ball of claim 1, wherein the plurality of porous structure perforations extends in a plurality of porous structure channels extending at least partly through the porous structure, the plurality of porous structure channels interconnecting the plurality of porous structure perforations and the plurality of hollow confined spaces.

5. The ball of claim 4, wherein the plurality of porous structure channels comprises an inlet opening interconnecting with the porous structure perforations and at least one outlet opening interconnecting with at least the part of hollow confined spaces.

6. The ball of claim 5, wherein the at least one outlet opening has a size of between 0.1 mm and 1 mm.

7. The ball of claim 4, wherein the plurality of porous structure channels has a diameter of between 0.3 mm and 0.8 mm.

8. The ball of claim 1, wherein the shell inner openings of the plurality of shell perforations align with at least a part of the perforations of the porous structure.

9. The ball of claim 1, wherein the shell channel has a diameter between 0.3 mm and 1 mm.

10. The ball of claim 9, wherein the diameter of the shell channel varies with the distance to the core of the ball.

11. A ball comprising a core, wherein the core comprises a substantially impermeable outer surface, the ball further comprising a porous structure encompassing the core, the porous structure being delimited by an outer surface and an inner surface, the outer surface of the porous structure comprising a plurality of perforations, the porous structure comprising a plurality of hollow confined spaces, with at least a part of the plurality of porous structure perforations and at least a part of the plurality of hollow confined spaces being interconnected, the ball further comprising a shell encompassing the porous structure, the shell being delimited by a shell outer surface and a shell inner surface, the shell comprising a plurality of shell perforations with at least a part of the plurality of shell perforations extending between a shell outer opening in the shell outer surface and a shell inner opening in the shell inner surface, and with at least part of the plurality of shell perforations being interconnected with the porous structure perforations, the interconnected plurality of shell perforations, porous structure perforations and hollow confined spaces defining a plurality of liquid passages allowing a liquid to be absorbed by the hollow confined spaces upon contact of the ball with the liquid, the ball further comprising control means for controlling absorption of the liquid by the ball and/or for controlling release of the absorbed liquid from the ball, wherein the control means comprises a perforated foil between the shell and the porous structure.

12. The ball of claim 11, wherein the perforated foil comprises a plurality of foil perforations, at least a part of the plurality of foil perforations not aligning with at least part of the plurality of shell perforations.

13. The ball of claim 1, wherein the ball is adapted for playing hockey on a surface, the control means being adapted for releasing at least a part of the absorbed liquid when hitting the ball with a predetermined force during play.

14. A ball comprising:

a core comprising a substantially impermeable outer surface, a porous structure encompassing the core, the porous structure delimited by an outer surface and an inner surface, the outer surface of the porous structure comprising a plurality of perforations, the porous structure comprising a plurality of hollow confined spaces, with at least a part of the plurality of porous structure perforations and at least a part of the plurality of hollow confined spaces being interconnected, a shell encompassing the porous structure, the shell delimited by a shell outer surface and a shell inner surface, the shell comprising a plurality of shell perforations with at least a part of the plurality of shell perforations extending between a shell outer opening in the shell outer surface and a shell inner opening in the shell inner surface, and with at least part of the plurality of shell perforations being interconnected with the porous structure perforations, the interconnected plurality of shell perforations, porous structure perforations and hollow confined spaces defining a plurality of liquid passages allowing a liquid to be absorbed by the hollow confined spaces upon contact of the ball with the liquid, and a perforated foil between the shell and the porous structure.

15. The ball of claim 14, wherein the perforated foil comprises a plurality of foil perforations, at least a part of the plurality of foil perforations not aligning with at least part of the plurality of shell perforations.

16. The ball of claim 1, wherein the length of the shell channel is between 1 mm and 20 mm.

17. A method of wetting a surface, the method comprising:

utilizing the ball of claim 1 to wet the surface.

18. A method wetting a surface, the method comprising:

immersing the ball of claim 1 in a liquid reservoir during a predetermined time period such that an amount of liquid can be absorbed by the ball and stored in the hollow confined spaces of the ball, and releasing at least a part of the absorbed liquid onto the surface by hitting the ball during play with a predetermined force.

* * * * *